US005609409A

United States Patent [19]

Diehl

[11] Patent Number: 5,609,409

[45] Date of Patent: Mar. 11, 1997

[54] CHEMILUMINESCENT STEMMED DRINKING GLASS

[76] Inventor: Kris R. Diehl, P.O. Box 10826, S. Lake Tahoe, Calif. 96158

[21] Appl. No.: 382,087

[22] Filed: Jan. 31, 1995

[51] Int. Cl.[6] ..... F21V 33/00

[52] U.S. Cl. ..... 362/101; 362/34; 362/806

[58] Field of Search ..... 362/34, 84, 101, 362/806, 253

[56] References Cited

U.S. PATENT DOCUMENTS

| | | | |
|---|---|---|---|
| 3,735,113 | 5/1973 | Stott | 362/101 |
| 3,878,386 | 4/1975 | Douglas | 362/101 |
| 4,344,113 | 8/1982 | Ditto et al. | 362/101 |
| 4,563,726 | 1/1986 | Newcomb et al. | 362/34 |
| 4,922,355 | 5/1990 | Dietz et al. | 362/101 |
| 5,070,435 | 12/1991 | Weller | 362/101 |
| 5,119,279 | 6/1992 | Makowsky | 362/101 |
| 5,171,081 | 12/1992 | Pita et al. | 362/101 X |
| 5,211,699 | 5/1993 | Tipton | 362/101 |

*Primary Examiner*—Stephen F. Husar

[57] ABSTRACT

A stemmed drinking glass with an upper cup supported by a hollow stem and connected to a base uses a chemiluminescent light stick inserted into the hollow stem to provide illumination. A demountable cup, demountable base, or hole extending upward through the bottom of the base joining the hollow stem and incorporating a plug facilitates insertion, containment, and removal of lightstick.

6 Claims, 8 Drawing Sheets

CHEMILUMINESCENT STEMMED DRINKING GLASS

BACKGROUND

1. Field of Invention

This invention relates to stemware, specifically to an illuminated stemmed drinking glass such as a wine or champagne glass.

2. Description of Prior Art

Several inventions have utilized electrical incandescent means to provide illumination for a lighted beverage glass. Evidence of this is disclosed in U.S. Patents: Stott U.S. Pat. No. 3,735,113; Douglas U.S. Pat. No. 3,878,386; Ditto et al. U.S. Pat. No. 4,344,113; Dietz et al. U.S. Pat. No. 4,922,355; Weller U.S. Pat. No. 5,070,435; Makowsky U.S. Pat. No. 5,119,279; Tipton U.S. Pat. No. 5,211,699. Problems of cost, difficulty of washing for reuse, and the need for battery replacement are probably reasons for their unpopularity.

Chemiluminescent light sticks made by American Cyanamid Company, Wayne, N.J. and under the trademark CYALUME provide an alternate means of illumination. We see this utilized by Newcomb et al. U.S. Pat. No. 4,563,726. Chemical light sticks consist of a flexible tube sealed at both ends, and housing two isolated chemicals, one of which is inside its own glass vial. Upon bending the flexible tube, the glass vial contained inside is broken thereby mixing and activating both chemicals to create cold light.

A problem arises when occasionally the light stick mentioned is bent and fractured to a point of leakage. Although the chemicals are non-toxic they are contaminated with small particals of glass in their activated state. This can present a safety hazard particularly in designs that house a light stick in the actual drinking cup of a drinking vessel. In designs just mentioned, the vertical hollow tube used to house a light stick inside the cup may fail in its sealing capability, and actual liquid to be consumed can become contaminated.

Another problem involving stemware arises in cleaning. Certain stemware requires expensive custom washing racks used with dishwasher machines, particularly glasses with longer stems. The problem is solved by the cup portion of said stemware being detachable from its stem and base portion thereby reducing the overall height.

OBJECTS AND ADVANTAGES

It is an object of the present invention to provide illumination in a stemmed drinking glass without incorporating electronics and batteries for economical and aesthetic reasons.

It is also an object to provide illumination in a stemmed drinking glass incorporating a chemiluminescent light stick.

It is another object to provide a means to isolate the predescribed light stick totally from the drinking cup of a drinking vessel for safety and aesthetic reasons.

It is a further object to provide an illuminated stemmed drinking glass whereby the stem in its entirety will radiate equally distributed light intensity.

It is still a further object to provide a stemmed drinking glass that dismantles to enable insertion, containment, and removal of a predescribed chemical light stick.

It is yet another object to provide a method whereby a stemmed drinking glass dismantles to fit any size washing rack from commercial dishwasher machines.

SUMMARY OF INVENTION

The above and other objects and advantages are accomplished with the present invention by a stemmed drinking glass comprising:

(a) an upper cup supported by a hollow stem, (b) a base portion joining the lower most extremity of said stem, (c) a chemiluminescent light stick method for illumination whereupon in activated state is inserted inside hollow stem, (d) a demountable cup, demountable base, or hole extending upward through the bottom of the base and joining the hollow stem incorporating a plug, to facilitate insertion, containment, and removal of light stick, (e) a drinking vessel totally isolating light stick from beverage for safety and and aesthetic reasons, and (f) a demountable cup portion of vessel to allow long stemmed glasses to fit any size washing rack from commercial dishwasher machines.

In preferred embodiments, the stemmed drinking glass is made of a transparent or transluscent material such as glass, plastic, or a combination thereof. The base and cup portions of the vessel may be demountable by threaded or other means to facilitate insertion, containment, and removal of a chemiluminescent light stick which is housed inside the hollow stem. A simplified model incorporates a hole extending upward through the bottom of the base and joining the hollow stem, and plug to facilitate insertion, containment, and removal of said light stick. Upon insertion of an activated light stick inside the hollow stem, a delightful glow of illumination is experienced with equally distributed light intensity through a portion or entirety of hollow stem. An exterior or interior vessel surface encompassing radially smooth, angular, textured flat, curvaceous, and faceted nature may be used to magnify and enhance illumination. A full range of colors for light sticks and material of construction of vessel may be utilized.

REFERENCE NUMERALS IN DRAWINGS

Figure 1:
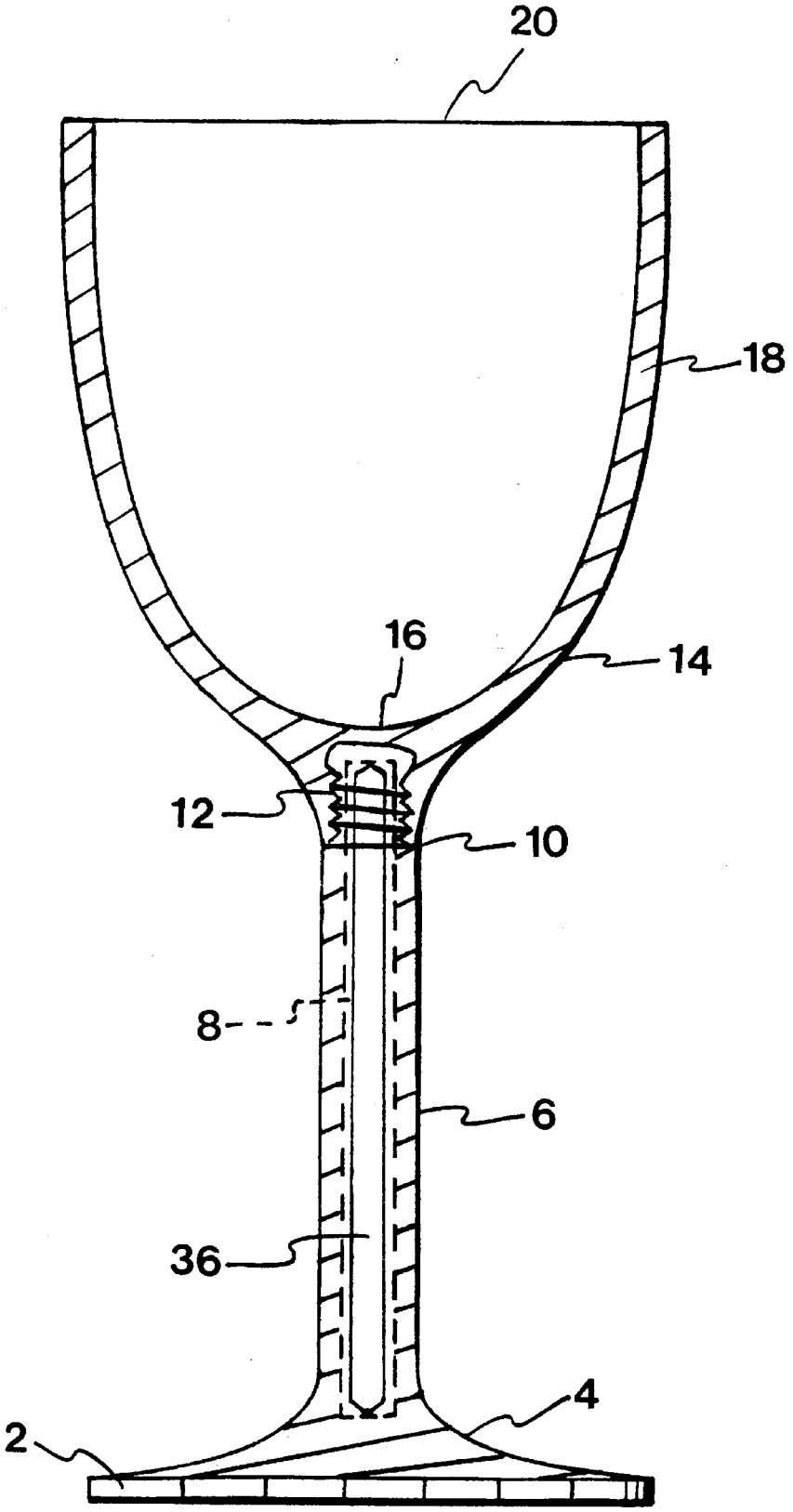
FIG. 1 is a vertical sectional view of the present invention incorporating a demountable and remountable cup.

2 bottom base rim
4 base
6 hollow stem
8 hollow cavity
10 separation point
12 threads
14 cup outer wall
16 cup inner wall
18 demountable cup
20 cup rim
22 plug
24 gripping lip
26 hole
28 decreasing radius
36 light stick
38 demountable base
40 cup
42 integral plug
44 O-ring seal
46 chemiluminescent
48 facet
50 illumination enhancement stem

DESCRIPTION OF THE PREFERRED EMBODIMENTS

Referring to FIG. 1, an embodiment of the chemiluminescent stemmed drinking glass is shown incorporating a demountable cup 18. A inner wall 16 of cup 18 totally isolates drinking fluid from a chemiluminescent light stick 36. A threaded means 12 facilitates separation and reattachment of cup 18 from a hollow stem 6 at separation point 10 and allows insertion, containment, and removal of light stick 36 which is housed inside said stem 6 during operation. Cup 18 and stem 6 are supported by a base 4 generally tapering upward in a decreasing radius to join stem 6 in integral fashion.

Figure 2:
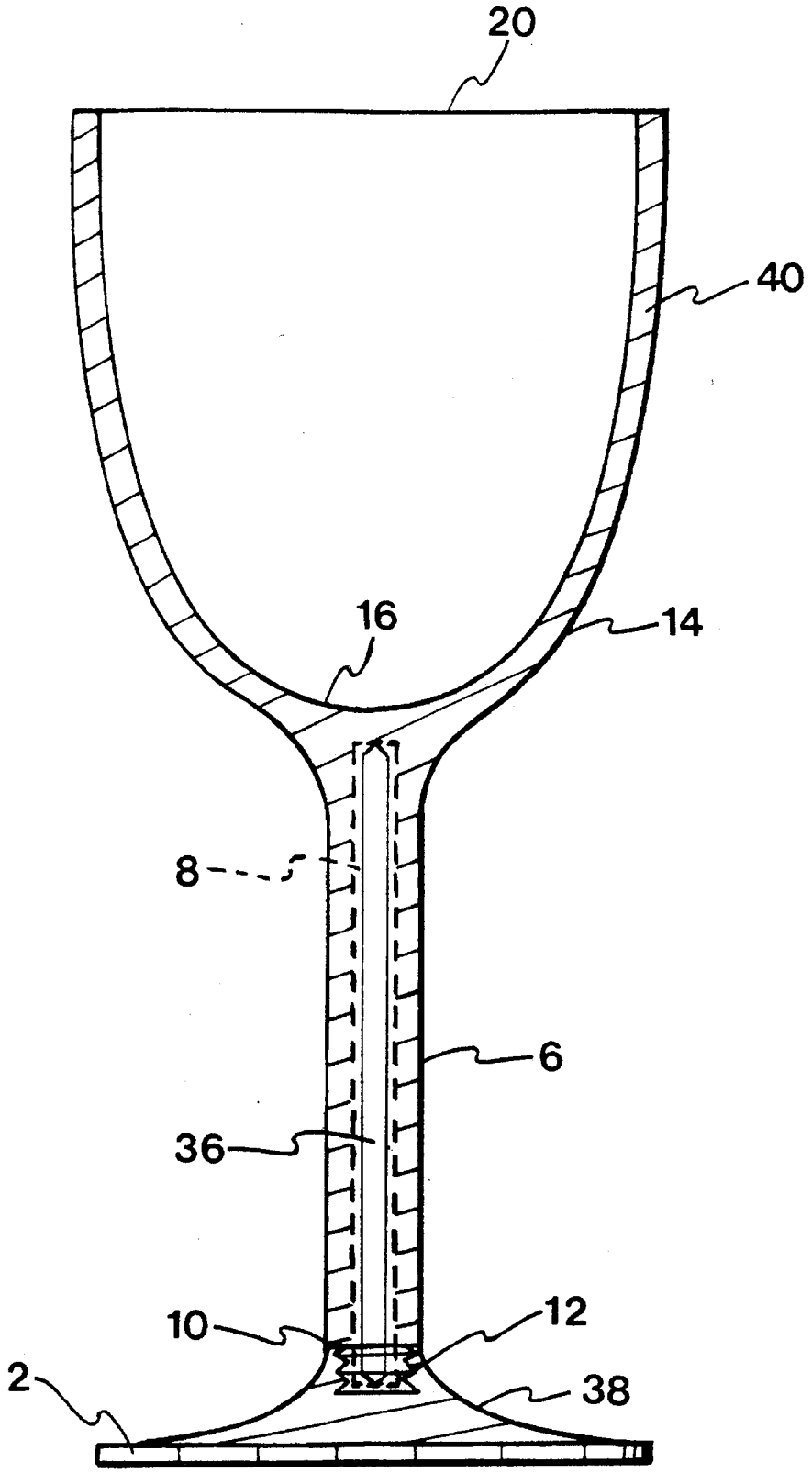
FIG. 2 is a vertical sectional view of the present invention incorporating a demountable and remountable base.

Referring to FIG. 2, a modification of FIG. 1 is shown whereby a threaded means 12 facilitates separation of a demountable base 38 at separation point 10 from stem 6. This allows insertion, containment, and removal of light stick 36 by a detachable and reattachable base method.

Figure 3:
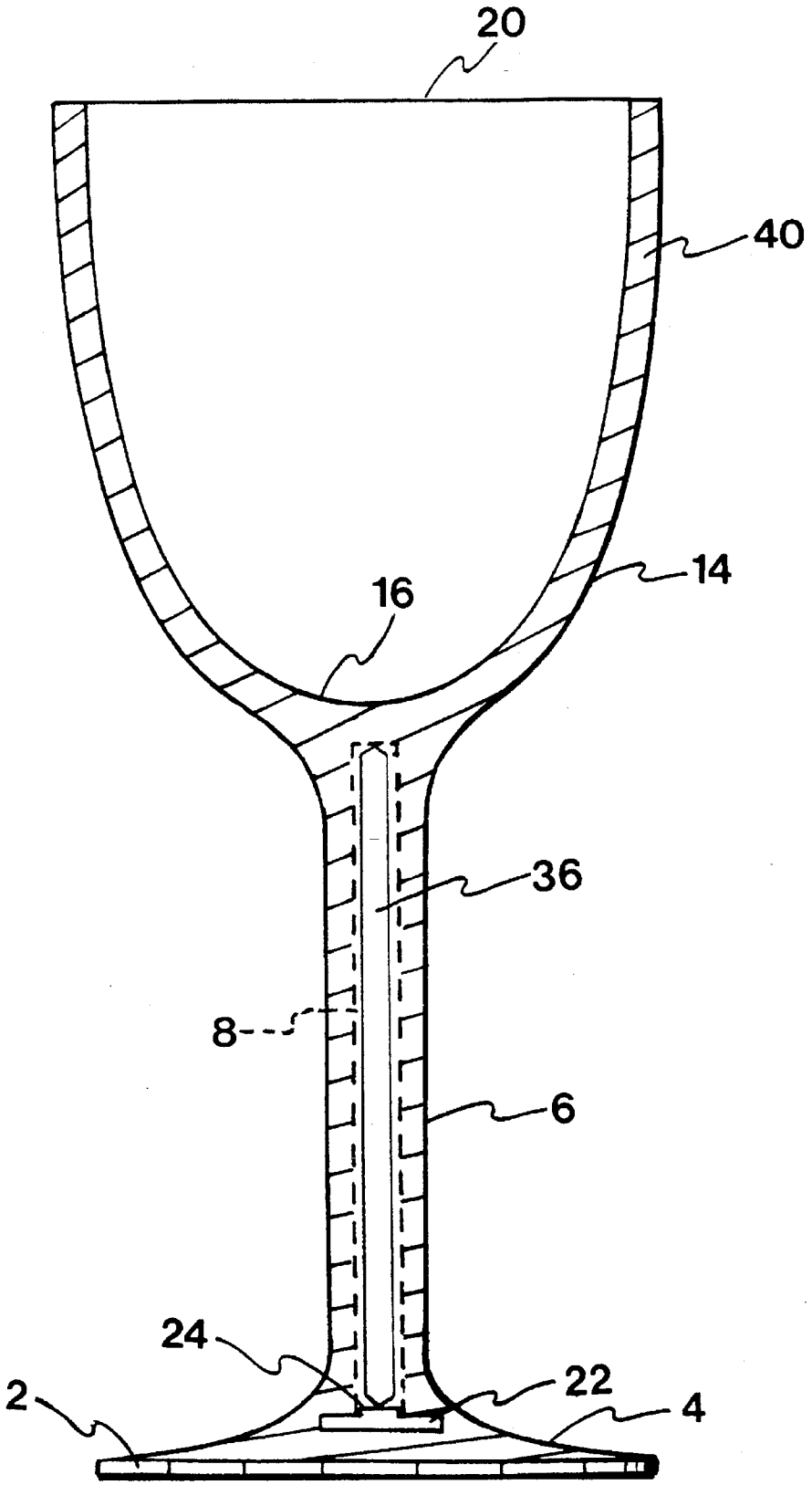
FIG. 3 is a vertical sectional view showing non-demountable construction.
Figure 4:
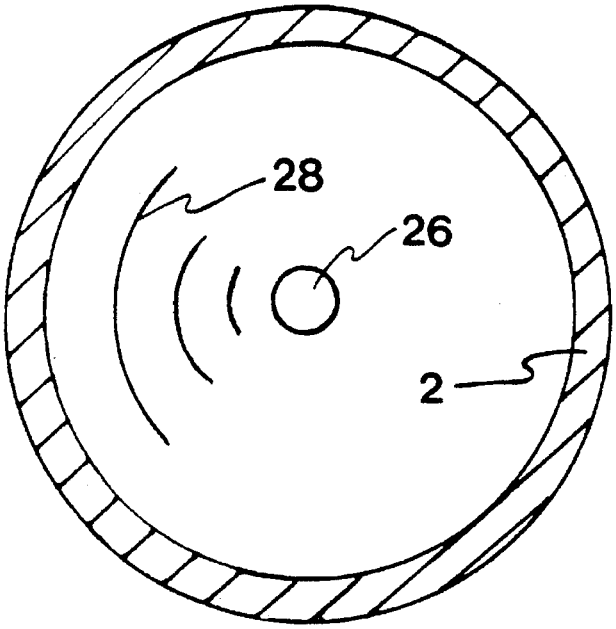
FIG. 4 is a bottom view of base portion of vessel.

Referring to FIG. 3 and FIG. 4, a modification of FIG. 1 and FIG. 2 is shown whereby the present invention is shown in non-demountable form. A cup 40 integrally connects to hollow stem 6 in a continuous extension to base 4. A circular hole 26 extends upwardly and centrally from bottom of base 4 to interconnect with hollow stem 6. A light stick 36 may be inserted through hole 26 and be housed in a hollow cavity 8 of stem 6.

A removable plug 22 seats in hole 26 and facilitates access for insertion, containment, and removal of light stick 36. A concave decreasing radius 28 extends upwardly and inwardly from a bottom base rim 2 to hole 26. This allows clearance between plug 22 and bottom base rim 2.

Figure 5:
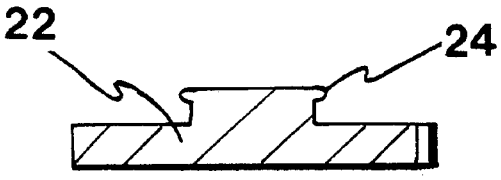
FIG. 5 is an enlarged sectional view of the plug portion of vessel.
Figure 6:
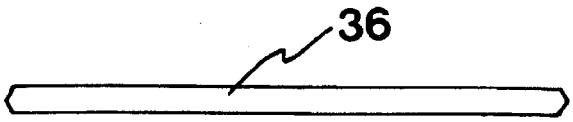
FIG. 6 shows an individual chemiluminescent light stick.

Referring to FIG. 5 and FIG. 6, a gripping lip 24 enables plug 22 to be held firmly in hole 26 to contain light stick 36.

Referring to FIG. 6A, threads 12 are shown on a threaded light stick 52 and may be used to receive demountable cup 18 and demountable base 38 therefore outlining an embodiment wherein the hollow stem portion is the chemiluminescent lightstick.

Figure 7:
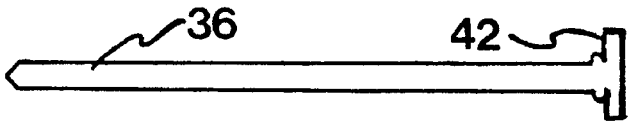
FIG. 7 shows a chemiluminescent light stick with integral plug.

Referring to FIG. 7, a integral plug 42 mates with light stick 36 to alleviate the need for plug 22.

The operation procedure consists of inserting a activated light stick inside the hollow stem 6 by removal of demountable base 38, demountable cup 18, or plug 22. Reattachment of said cup, base, or plug provides containment of light stick 36. A pleasing glow of colored illumination with equally distributed light intensity through potentially the entirety of stem 6 is accomplished by light stick 36 means.

A liquid tight relationship between said cups, and said stem are accomplished by inner wall 16 and totally isolates light stick 36 from beverage to be consumed thus preventing contamination.

By separating demountable cup 18 from stem 6, the height of the glass is reduced and will allow ease of cleaning and eliminate the need for expensive custom washing racks used with commercial dishwasher machines.

Figure 8:
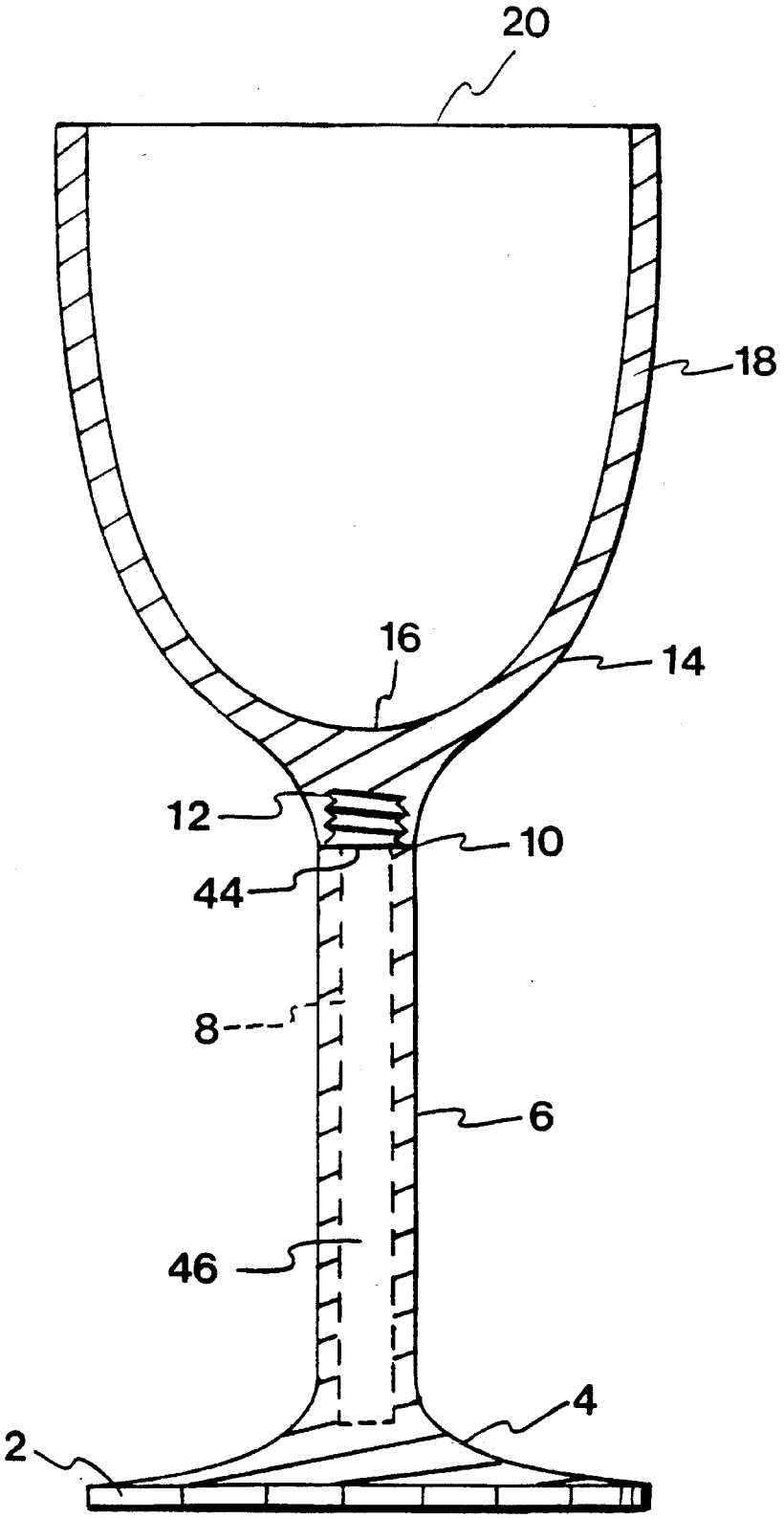
FIG. 8 is a vertical sectional view of the present invention incorporating a demountable and remountable cup, the modification being to accept chemiluminescent fluid and alleviate the need for a light stick.
Figure 9:
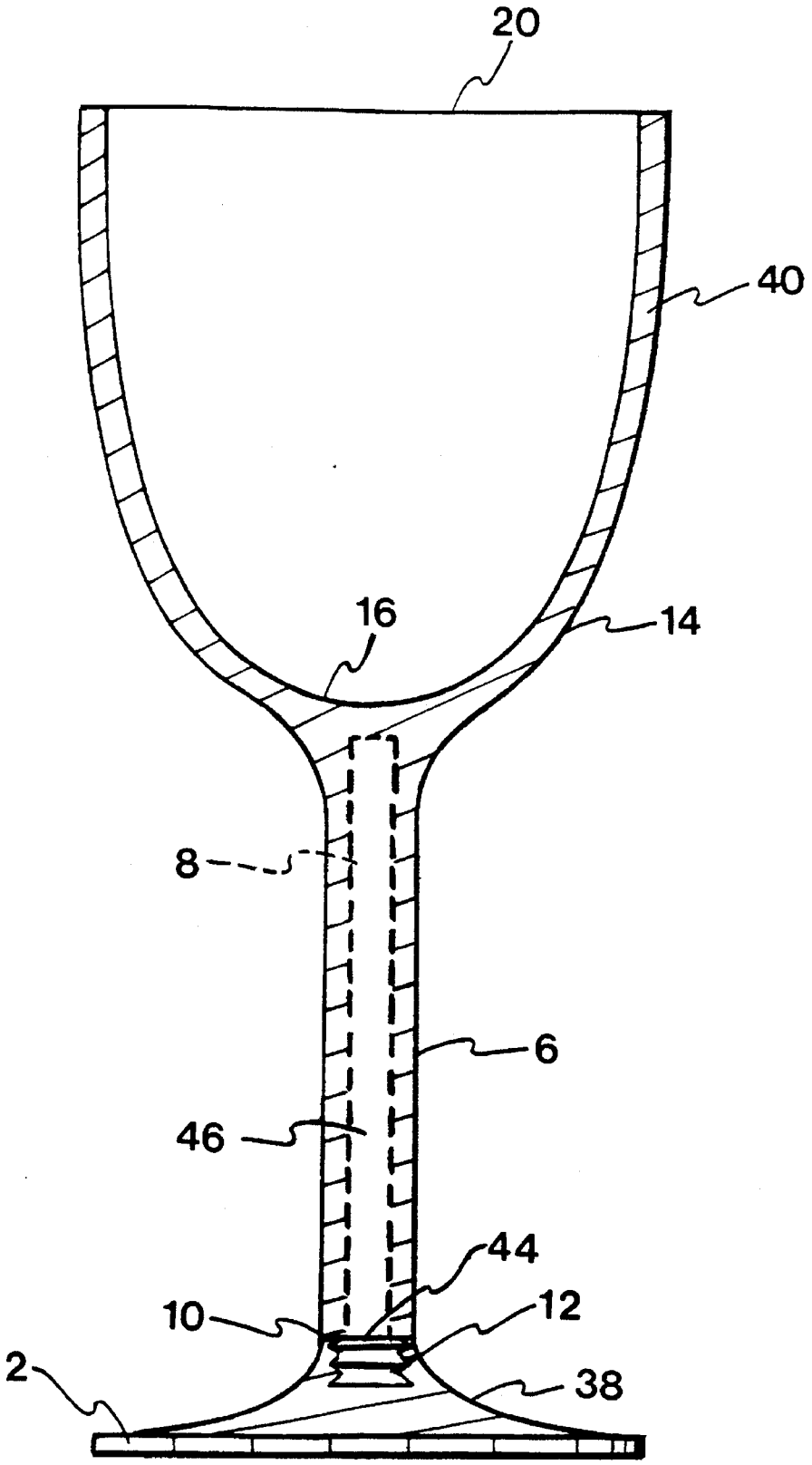
FIG. 9 is a vertical sectional view of the present invention incorporating a demountable and remountable base, the modification being to accept chemiluminescent fluid and alleviate the need for a light stick.
Figure 10:
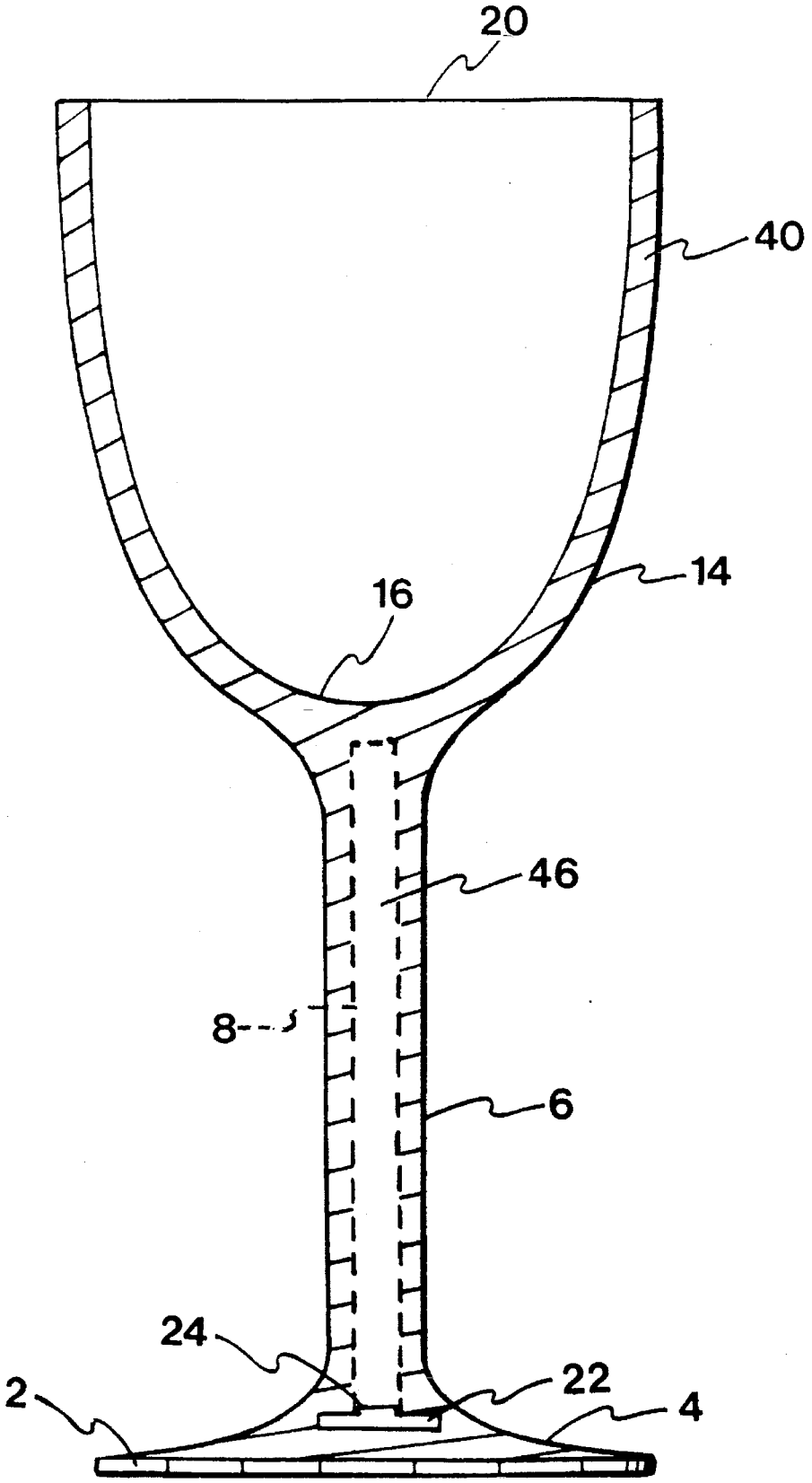
FIG. 10 is a vertical sectional view of the present invention showing integral construction, the modification being to accept chemiluminescent fluid and alleviate the need for a light stick.

Referring to FIG. 8, FIG. 9, and FIG. 10 we show a modification of FIG. 1, FIG. 2, and FIG. 3 respectfully whereby the need for a light stick is alleviated and is replaced by chemiluminescent fluid fully described in the modification of the present invention.

Figure 11:
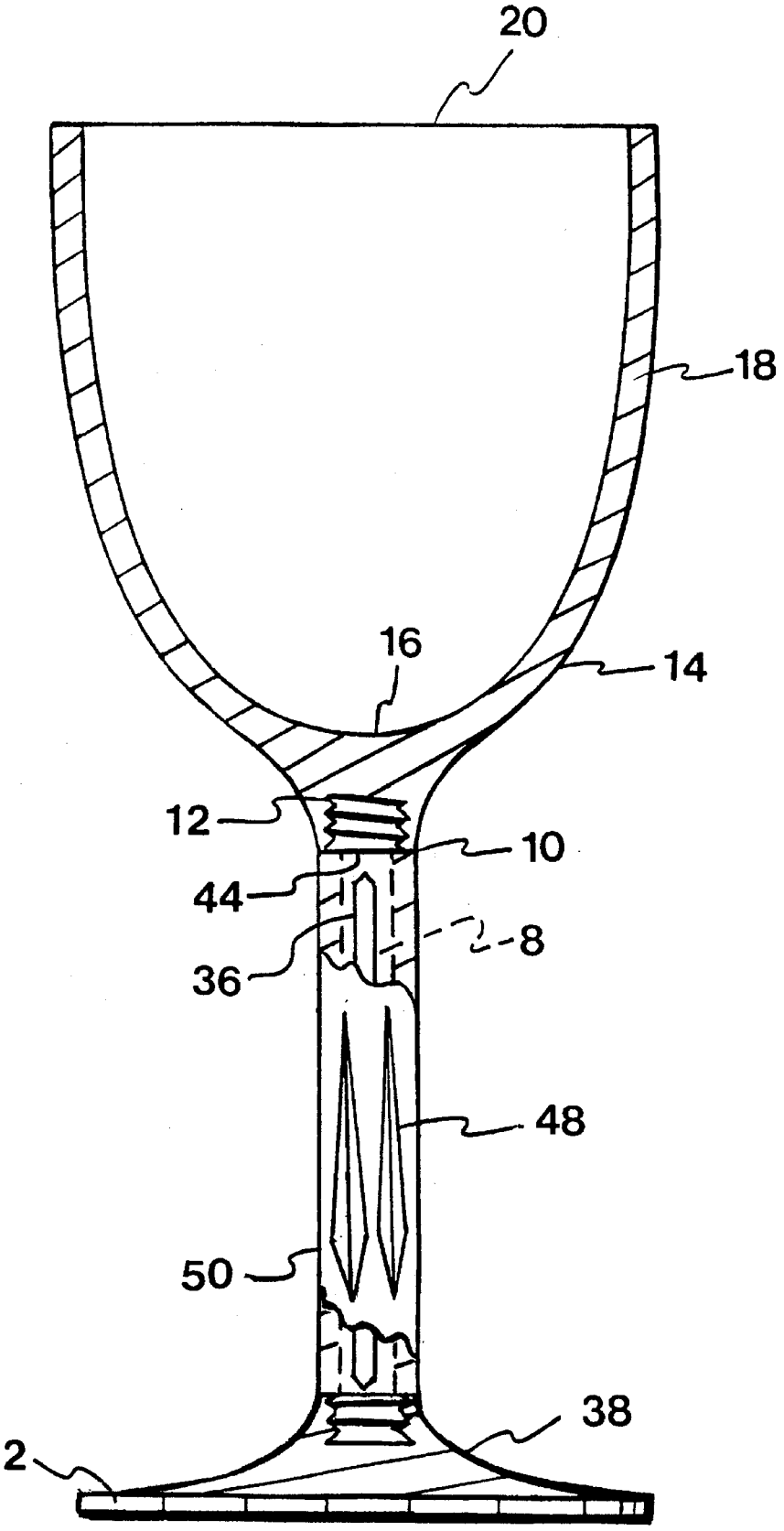
FIG. 11 is a vertical sectional view of the present invention incorporating a demountable and remountable base, a demountable and remountable cup, and facets on stem exterior surface for enhancement and magnification of chemiluminescent illumination.

Referring to FIG. 11, an embodiment of the present invention is shown incorporating demountable and remountable cup 18, demountable and remountable base 38, a illumination enhancement stem 50 whereby a facet 48 or plurality of facets are used to enhance and magnify chemiluminescent illumination.

MODIFICATION OF THE INVENTION

In the alternative embodiment of FIG. 8, the improvement being that illumination is provided not by a light stick but by a chemiluminescent fluid 46 which is directly deposited inside hollow cavity 8 upon removal of demountable cup 18. A o-ring seal 44 prevents leakage. This system allows solid material of hollow stem 6 in its entirety to magnify equally distributed light along with portions of cup 18 for a more pleasing effect.

Referring to FIG. 9, an alternative embodiment is shown whereby demountable base 38 allows insertion, containment, and removal of chemiluminescent fluid 46 by a detachable and reattachable base method.

Referring to FIG. 10, a modification is shown whereby the present invention is in non-demountable embodiment. Plug 22 seats in hole 26 and facilitates insertion, containment, and removal of chemiluminescent fluid 46.

RAMIFICATIONS AND SCOPE

While particular examples of the present invention are described and shown, it is obvious that changes and modifications may be made threin without departing from the spirit and scope of the invention.

I claim:

1. A chemiluminescent stemmed drinking glass comprising:

a cup portion supported by a hollow stem portion which in turn is supported by a base portion;

said hollow stem portion being illuminated at least partially by a chemiluminescent means contained within said hollow stem portion; and said hollow stem portion being made of either a transparent or translucent material.

2. The apparatus of claim 1, further including a hole extending upwardly and centrally through said base portion communicating with a hollow cavity within said hollow stem portion, and a plug means in relation to said hole to facilitate insertion, containment, and removal of said chemiluminescent means used to illuminate said hollow stem portion.

3. The apparatus of claim 1, further including a means for detaching and reattaching said cup portion to said hollow stem portion.

4. The apparatus of claim 1, further including a means for detaching and reattaching said hollow stem portion to said base portion.

5. The apparatus of claim 2, further including a means for detaching and reattaching said base portion to said hollow stem portion.

6. The apparatus of claim 1, further including a magnification means whereby the illumination from said chemiluminescent means is magnified.

* * * * *

UNITED STATES PATENT AND TRADEMARK OFFICE

CERTIFICATE OF CORRECTION

PATENT NO. : 5,609,409

DATED : Mar. 11, 1997

INVENTOR(S) : Kris R. Diehl

It is certified that error appears in the above-indentified patent and that said Letters Patent is hereby corrected as shown below:

Col. 2, line 36, after "textured" insert "-,-" thereby having a comma directly after the word "textured".

Page 2, Col. 3, line 28, after "chemiluminescent" insert "-fluid-".

Page 2, Col. 4, lines 1 through 5, please delete the following sentence: "Referring to Fig. 6A, threads 12 are shown on a threaded lightstick 52 and may be used to recieve demountable cup 18 and demountable base 38 therefore outlining an embodiment wherein the hollow stem portion is the chemiluminescent lightstick."

UNITED STATES PATENT AND TRADEMARK OFFICE

CERTIFICATE OF CORRECTION

PATENT NO. : 5,609,409
DATED : Mar. 11, 1997
INVENTOR(S) : Kris R. Diehl

It is certified that error appears in the above-indentified patent and that said Letters Patent is hereby corrected as shown below:

Col. 6, line 7, change "2" to "-3-" thereby causing claim 5 to read: "The apparatus of claim 3, further including a means for detaching and reattaching said base portion to said hollow stem portion."

Signed and Sealed this

Ninth Day of September, 1997

*Attest:*

Bruce Lehman

BRUCE LEHMAN

*Attesting Officer*

*Commissioner of Patents and Trademarks*